United States Patent [19]

Muehlhausen II

[11] 4,262,985

[45] Apr. 21, 1981

[54] CONNECTOR FOR PLURAL CONDUCTORS

[75] Inventor: Almon A. Muehlhausen II, Thousand Oaks, Calif.

[73] Assignee: Bell Telephone Laboratories, Incorporated, Murray Hill, N.J.

[21] Appl. No.: 23,829

[22] Filed: Mar. 26, 1979

[51] Int. Cl.[3] ..... H01R 13/58

[52] U.S. Cl. ..... 339/99 R; 339/103 M

[58] Field of Search ..... 339/103 M, 103 R, 97 P, 339/97 R, 98, 99 R

[56] References Cited

U.S. PATENT DOCUMENTS

| | | | |
|---|---|---|---|
| 3,772,635 | 11/1973 | Frey et al. | 339/99 R |
| 4,006,957 | 2/1977 | Narozny | 339/103 M |
| 4,017,140 | 4/1977 | Reavis, Jr. et al. | 339/98 |
| 4,101,189 | 7/1978 | Moser et al. | 339/103 M X |

*Primary Examiner*—Neil Abrams

*Attorney, Agent, or Firm*—Sylvia J. Chin; Joseph P. Kearns

[57] ABSTRACT

A connector (10) comprising an index strip (100) with wire-retaining slots (112) for receiving individual conductors (20), a connector module (200) with wire-engaging contact elements (40) and an index-strip portion (203), and a module cap (300). The wire-retaining slots (112, 212) in the index strip and index-strip portion of the connector module have flexible inwardly curved flanges (130, 230) adjacent to one end of the slot. Each corresponding pair of flanges, which depend from adjacent slot-defining upright members (110, 210), deflect inwardly into the wire-retaining slot during wire indexing to securely grip an inserted conductor (20, 30), the deflected flanges being capable of biasing toward each other to create an even tighter grip on a conductor when conductor pull out from that end is attempted. The flanges also tend to center each associated conductor in its associated slot, thereby minimizing the effect of misaligned stuffer means either in the connector module or cap during final positioning of conductors in the index strips. The flanges cooperate with aligning means (150, 250) adjacent to the other end of the wire-retaining slot to center each conductor along the entire slot. The connector also includes novel interlocking features which strengthen the structure of the connector and aid to improve the water resistance and the dielectric properties of the connector when assembled.

33 Claims, 16 Drawing Figures

CONNECTOR FOR PLURAL CONDUCTORS

BACKGROUND OF THE INVENTION

1. Technical Field

This invention relates to devices for making electrical connections between conductors and more particularly to improved devices which reliably grip and align the conductors in wire-retaining slots to ease the splicing operation and assembly of such devices.

2. Description of the Prior Art

Connectors of the type disclosed in U.S. Pat. No. 3,772,635, issued Nov. 13, 1973, to Frey et. al. systemize cable splicing work and are universal in that they can accommodate a wide size range of conductors. In the basic splice unit, the connector disclosed in Frey et al comprises an index strip with wire-retaining slots for receiving individual insulated conductors or wires, a connector module with double-ended slotted beam contact elements and an index-strip portion, and a module cap.

The index strip separates conductors of a first group with slot-defining upright members and acts as a temporary wire holder preparatory to splicing. The index-strip portion of the connector module is similar to the index strip and operates to index and hold conductors of a second group. Each slotted beam contact element connects a conductor in the first group with the associated conductor in the second group.

Normally, the connector is assembled with a tool and holder such as described in Frey et al. Each of the three connector components includes along their end walls vertical grooves which fit guiding tabs in the holder.

In assembling the connector disclosed in Frey et al, a splicer first mounts the index strip onto the holder through the guiding tabs. With the slot-defining members, which alternate in height to provide additional visual and physical guidance, the splicer then locates the conductors into their separate wire-retaining slots. Then the head of the tool is applied to the strip, snubbing the conductors down into position and severing the conductors at the rear end of the wire-retaining slots. Then the connector module is placed into the same guiding tabs of the holder and pressed down sufficiently so that it snap-mounts onto the index strip. At that time the slotted beam contact elements also make electrical engagement with the conductors in the index strip. Then the second group of wires are similarly indexed, snubbed and severed. During the snubbing, the conductors in the connector module engage the slotted beam contact elements. Finally, the cap is mounted via the same guiding tabs and snap-mounted onto the module to complete the basic splice.

While the connector disclosed in Frey et al has proven satisfactory for the most part, certain improvements have been found desirable. Various improvements can be made to render the prior art connector even more reliable and efficient in terminating conductors of different sizes, and less craft-sensitive.

One aim is to minimize the effects of axial loads which cause conductors to pull out from the front side of the index strip or index-strip portion, especially after the conductors are snubbed and severed at the rear end of the wire-retaining slots.

Another aim is to permit accommodation of a greater size range of conductors in the wire-retaining slots without reducing reliability and splicing efficiency. Desirably smaller conductors, as well as larger conductors, are precisely aligned and centered in their respective wire-retaining slots during indexing for snubbing and for engaging their assigned slotted beam contact element.

Another aim, especially with the larger conductors, is to hold the conductors so that they do not pop back out vertically, opposite to the direction they are put in.

A further aim is to increase the electrical isolation between the exposed ends of the conductors within each group. The larger conductors are especially more prone to electrical leakage since they are physically closer to one another than are the smaller conductors, given the same wire-retaining slot spacing.

SUMMARY OF THE INVENTION

Pursuant to one aspect of the invention, the index strip and the index-strip portion of the connector module each includes a pair of wire-gripping and aligning flanges adjacent to the front end of each wire-retaining slot. The flanges, which attach to adjacent posts, curve inward into the slotted region of each wire-retaining slot. When an insulated conductor is inserted downward into the wire-retaining slot, the flanges deflect inward to grip and center the inserted conductor. The flanges flex the appropriate amount needed to accommodate the particular conductor.

Each flange includes a leading edge which indents the insulation of the wire, as well as roughened surfaces, to ensure reliable gripping. Advantageously, the flanges have a tendency of increasing their grip by closing in on the wire when axial loads pull on the wire from the front end of the wire-retaining slot.

In accordance with a further aspect of this invention, each pair of flanges cooperates with aligning means adjacent to the rear end of each wire-retaining slot to center the associated wire along the entire slot length. This ensures proper alignment of each corresponding slotted beam contact element with its respective wires.

In the illustrative embodiment, the flanges have thickened upper flange sections which form a funnel-like entrance at the front end of each wire-retaining slot and lower flange sections which grip and center the indexed wires. The upper flange sections protrude over the lower flange sections into the wire-retaining slot to define at their junction abrupt edges or lips which prevent inserted wires from vertically popping out. Also, in another embodiment, the bottom edges of the lower flange sections also have thickened portions or lips to ensure that smaller size conductors are maintained between the flanges for even more effective aligment during indexing.

In accordance with another aspect of this invention, the rear sides of the flanges operate as latching members. Also, alternate posts feature chamfered rear roof latching surfaces. These two features latch associated surfaces which are molded in the front module component of the connector module, hence preventing forward movement of the front module half, and buildup of internal mechanical stresses in heat-staked joints in the connector module.

In the connector disclosed in Frey et al, the index strip includes along its rear side, slot-defining risers which aid in gripping and aligning inserted wires. Each riser comprises a pair of spaced-apart upright arms integrally attached to and extending from a ledge of the index strip at one end and at the other end thickening transversely into a shoulder. The shoulders are integrally connected to a supporting central member or web. Each arm is spaced apart from and adjacent to an arm from a neighboring riser to define the rear end of the wire-retaining slot. The prior art connector module includes a skirt for engaging the rear side of the wire-retaining slots in the index strip.

Pursuant to a further aspect of this invention, the index strip is redesigned with a vertical through notch in the shoulder of each riser and a corresponding notch on the ledge below. Also, the rear wall of each associated web is recessed to provide a vertical through path between the notches. In the improved connector module, the skirt includes a plurality of vertical ribs, each of which interlocks with the appropriate set of notches in the index strip. The rib-notch interlocking feature reinforces the module skirt against flexing during the assembly operation. It also advantageously increases the dielectric paths, as well as water paths between severed wire ends which are housed in recesses of the module skirt. This rib-notch interlocking feature is also incorporated between the index-strip portion of the connector module and the module cap.

The invention will be readily understood by the following description of certain embodiments by way of example in conjunction with the drawing.

DETAILED DESCRIPTION OF THE ILLUSTRATIVE EMBODIMENTS

The inventive aspects of this invention as depicted in the illustrative embodiments are improvements which have been added to the cable splice connector disclosed in the Frey et al patent but are not limited thereto. To the extent that patent is relevant to this disclosure, it is hereby incorporated by reference. As with the connector components disclosed in Frey et al, the improved index strip, the two components of the connector mdoule, and the module cap are each made by conventional plastic molding techniques from materials such as polycarbonate, which provides good mechanical strength and adequate electrical insulation.

Figure 1:
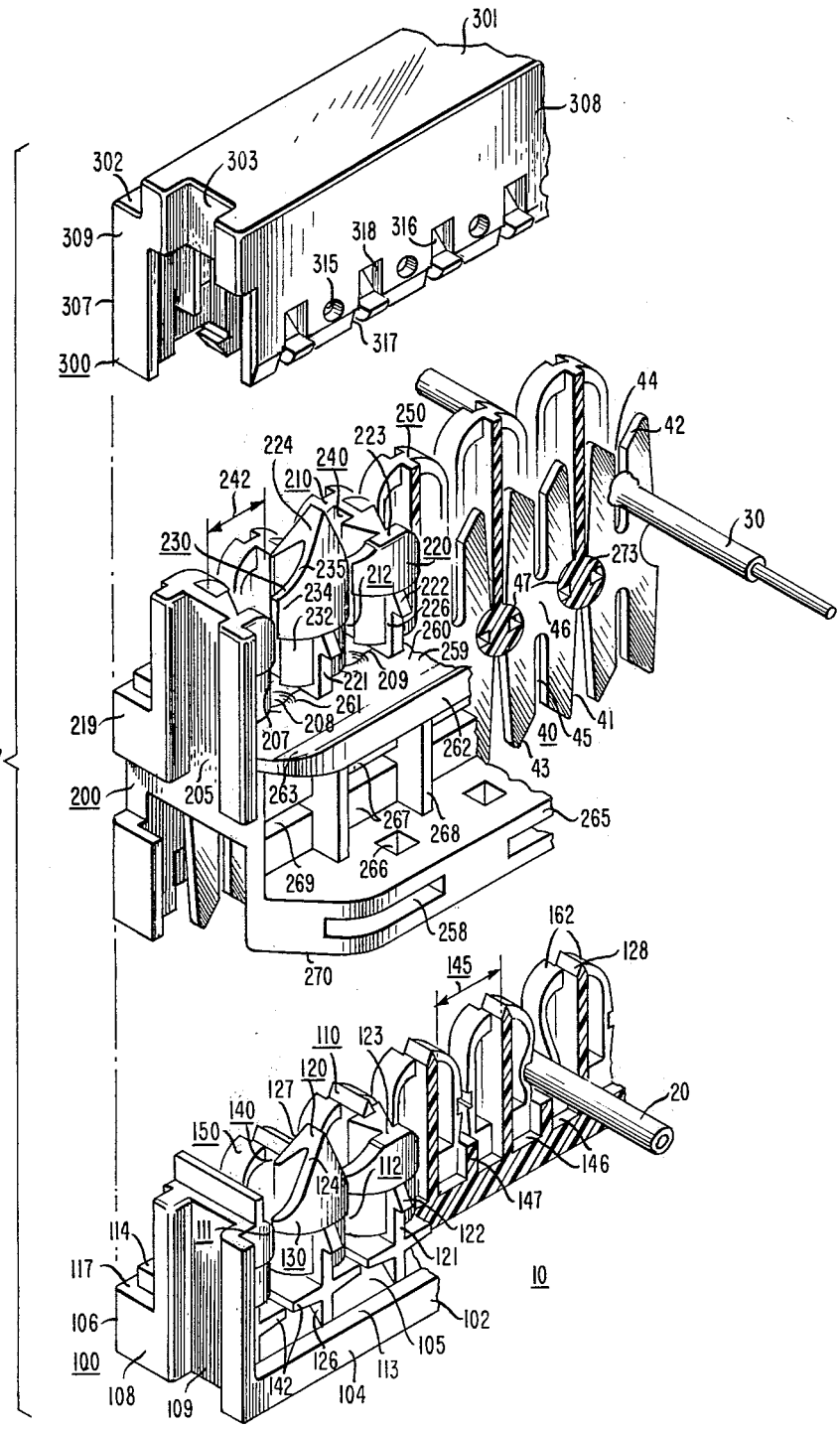
FIG. 1 is an exploded partial perspective view showing the index strip, the connector module, and the module cap made in accordance with this invention.

Depicted in exploded partial perspective front view in FIG. 1, the illustrative embodiment 10 of the inventive connector comprises an index strip 100, a connector module 200 with slotted beam contact elements 40, and a module cap 300. The illustrative embodiment is a two-wire butt assembly, where one or more insulated conductors or wires 20 of a first group are connected respectively to one or more insulated conductors or wires 30 of a second group.

Index Strip

Shown in FIG. 1 and in greater detail in FIGS. 2–7, the index strip 100 is an elongate block of material with a base 102, a front side 104, a rear side 106, and two end walls 108 with vertical grooves 109. A plurality of longitudinally spaced-apart upright members 110 extend from the base body portion 102 to define wire-retaining slots 112 therebetween. The members 110 are set back from the front edge of the index strip 100 where there is a ledge 113. Each upright member 110, except for the end members 111, comprises a front post 120, a dome-roofed riser 150 in the rear, and a web 140 connecting the post and the riser.

Figure 2:
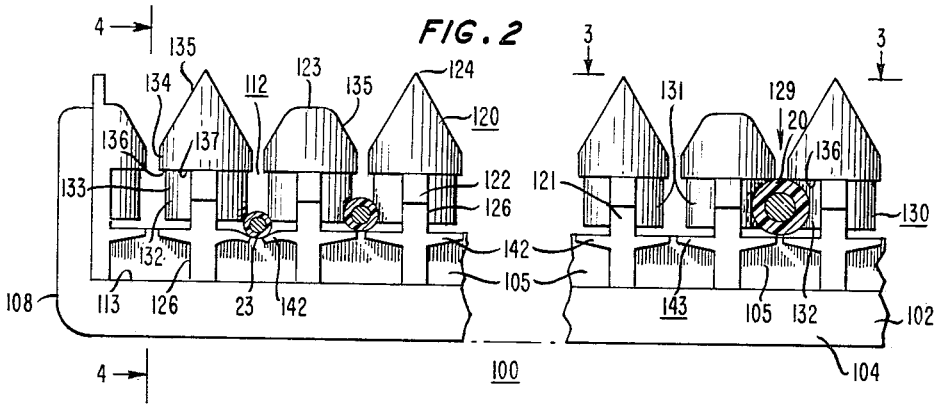
FIG. 2 is a partial front elevation view of the index strip.

Each front post 120, somewhat triangular in cross section, has a flattened front apex wall 121 to which is integrally attached a latching nub 122. The posts 120 alternate with flat roofs 123 and peaked cathedral roofs 124 as shown in FIG. 2.

Figure 3:
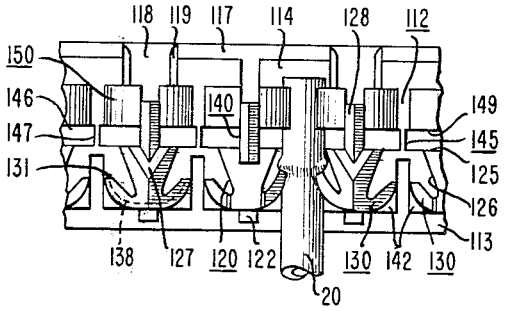
FIG. 3 is a top view of the index strip taken along line 3—3 in FIG. 2.

Integrally attached to either sidewall 126 of each post 120 is a flexible flange 130, which curves inward into one of the wire-retaining slots 112, as most clearly depicted in FIG. 3. Referring to FIGS. 2 and 3, each flange 130 defines substantially with its neighboring flange on the adjacent post the front end of a wire-retaining slot 112.

Each flange 130 has a leading edge 131 for indenting the insulation of wires, a lower wire-gripping and aligning flange section 132 which is roughened on its front surface 133, and an upper flange section 134. Each upper flange section 134 tapers to form a guiding surface 135 which in conjunction with the neighboring flange forms a funnel-like entrance for a wire 20 to be inserted. Where the post 120 is cathedral roofed, the taper is continuous between the post 120 and the flange 134.

The top flange section 134 overhangs the front surface 133 of the lower flange section 132 and forms a lip 136 at their junction 137. The apex wall 121 above the nub 122 also overhangs and is continuous with the upper flange section 134. FIG. 3 shows the front surface 133 of the lower flange section with a slashed line 138. The back surface of the lower flange section 132 is continuous with that of the upper flange section 134.

Figure 4:
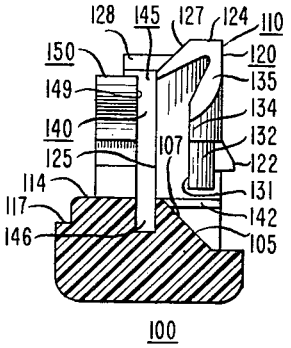
FIG. 4 is a cross-sectional view of the index strip taken along line 4—4 in FIG. 2.

Beneath each flange 130, a vertical yielding flexible membrane 142 integrally attaches to either sidewall 126 of each post as shown in FIGS. 1–4. Each membrane 142 extends horizontally to substantially abut the membrane 142 of an adjacent post 120 to define a split platform 143 for each wire-retaining slot 112. Below each split platform 143 is a floor 105 which tilts upward from ledge 113 into the interior of the index strip to terminate near the interior walls 125 of the post 120 and at the normally horizontal level of the membranes 142. In the illustrative embodiment, the membranes 142 also integrally attach to the floor 105 along its interior edge 107 as depicted in FIG. 4. Each floor 105 supports the associated membranes 142 when they deflect.

Figure 6:
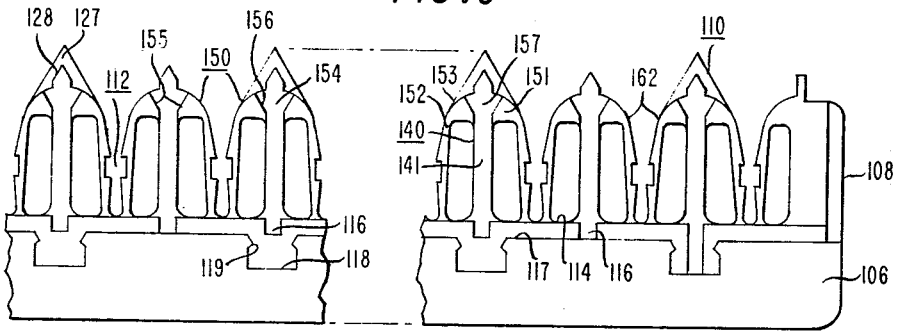
FIG. 6 is a partial rear elevation view of the index strip.
Figure 5:
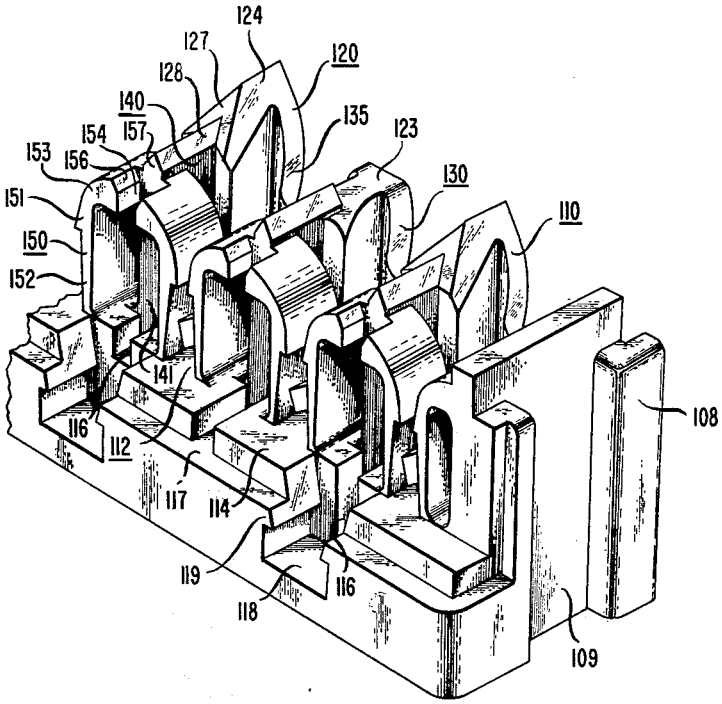
FIG. 5 is a partial isometric rear view of the index strip.

As most readily visible in FIGS. 4–6, each member 110 includes over the riser 150 and web 140, an elongate triangular rib 128. Also, the peaked-cathedral roofed post 120 have chamfered rear roof surfaces 127, which are coterminous with the front end of the ribs 128. The ribs 128, the chamfered surfaces 127, and the flanges 130 interlock with associated surfaces in the connector module 200 to be later described. The chamfered surfaces 127 are readily visible during splicing and can be color-coded for pair identification of conductors.

Behind the posts 120 are vertical slots 145, each of which is defined by two adjacent webs 140, the interior walls 125 of the posts 120 and the interior surfaces 149 of risers 150 as seen in FIGS. 1, 3 and 4. Each vertical slot 145 extends below the level of the wire-retaining slots 112 to form two wells 146 separated by a thin wall 147.

Figure 7:
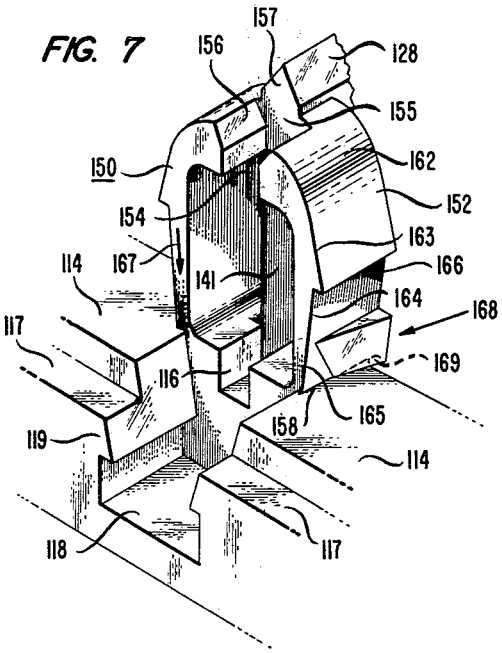
FIG. 7 shows in a rear isometric view one riser in greater detail.

Referring to FIGS. 5, 6, and 7, substantially along the entire rear surface of the strip 100 is a ledge 114 with a notched edge 117. The ledge 114 serves as a cutting anvil to support severing the conductors 20. The ledge 114 and edge 117 are broken periodically by slots 118 which have beveled snap-in entrance wings 119. Each slot 118 is advantageously located laterally in line with the upright members 110 with peaked cathedral roofs 124, and out-of-line with the wire-retaining slots 112.

Mounted on the ledge 114 along the rear side of the strip 100 are the risers 150, each with a pair of substantially upright flexible arms 152 and a shoulder 153 connecting the arms 152. Each shoulder 153 is integrally attached to the associated web 140 which provides structural support for the risers 150. Each shoulder 153 also includes a vertical through notch 154 in the rear surface 151 of the riser 150. The notch 154 has a funnel-like entrance 155 defined by tapered sidewalls 156 and a recessed rear wall 157. The rear wall 141 of the associated web 140 is coplanar and in vertical alignment with the recessed rear wall 157 of the riser 150. The ledge 114 is further broken by a plurality of notches 116, each notch 116 being associated with and in vertical alignment with a corresponding notch 154 in each riser 150.

Seen in greater detail in FIG. 7, each arm 152 comprises a top section 163, a thinned middle section 164, and a bottom section 165. The two lower sections 164 and 165 are chamfered on the outer sidewall 166 of the arm to decrease in thickness, as depicted by arrow 167 in the downward vertical direction, while the bottom section 165 also decreases in thickness in the rearward direction as depicted by arrow 168. Chamfering the outer sidewall 166 of each arm 152 occurs in conjunction with a groove 169 in the region of its junction 158 with ledge 114. The groove 169 disappears gradually going rearward because the downward and rearward tapering has thinned out the rear part of the arm first.

The downward tapering and the groove 169 render the arms 152 more compliant in the region of the junction 158 to minimize vertical ejection forces. The rearward tapering minimizes vertical forces, primarily after the conductors have been severed, during which the conductor ends tend to flatten and balloon outward toward the arms near the point of severance. The thinned-out middle section 164 allows ready flexibility in each arm 152 to vertically retain a conductor 20.

To index a wire or insulated conductor 20, the conductor 20 is lowered into its associated wire-retaining slot 112 in a direction normal to the longitudinal axis of the slot 112. The insertion is guided by the chamfered surfaces 135 (FIG. 2) of the flanges 130 in the front end and the dome-shaped surfaces 162 (FIG. 6) of the risers 150 in the rear end.

As the conductor 20 moves downward, depicted by arrow 129 in FIG. 2, the flanges 130 associated with the slot 112 deflect inward even further into the wire-retaining slot 112 depending on the thickness of the conductor 20 as shown in FIG. 3.

The outermost edges 131 of the adjacent flanges 130 indent the insulation of a wire 20 to grip it while the roughened front flange surfaces 133 make good frictional contact. The flanges 130 deflect horizontally inward approximately the same amount to thereby center the inserted conductor 20 in wire-retaining slot 112. As seen in FIG. 2, the conductor 20 is held by the lower flange sections 132 while the lips 136 of the upper flange sections 134 prevent the conductor 20 from vertically popping back out.

At the same time, the arms 152 in the rear horizontally deflect away from each other in the vicinity of the conductor, and because of their mode of suspension (the thinned middle section 164), toward each other in the region above the conductor 20 as shown in FIG. 1. Because the arms 152 are thin-walled near their junction 158 with the ledge 114, the arms are also more flexing near the bottom, hence reducing vertical ejection forces otherwise occurable.

As can be seen in FIG. 3, the conductor 20 is substantially centered and aligned along the entire length of the wire-retaining slot 112. This is achieved regardless of the size of the conductor 20. Thus, each conductor 20 is precisely located for snubbing and engagement with a contact element 40.

Each pair of flexible membranes 142 cooperate as the vertically confining means for the associated conductor 20 when the connector module 200 snap-mounts on the index strip 100. In FIG. 2, a pair of membranes 142 are shown deflected. The flexible membranes 142 yield vertically while always urging the conductor 23 to the center of the associated wire-retaining slot 112. Together the associated flanges 130 and the membranes 142 maintain a conductor 20 in the center during snubbing in preparation for ultimate engagement with the associated contact elements 40. This is critical especially with smaller sized conductors which could otherwise slip to either side of the wire-retaining slot 112 in the connector disclosed in Frey et al.

Figure 14:
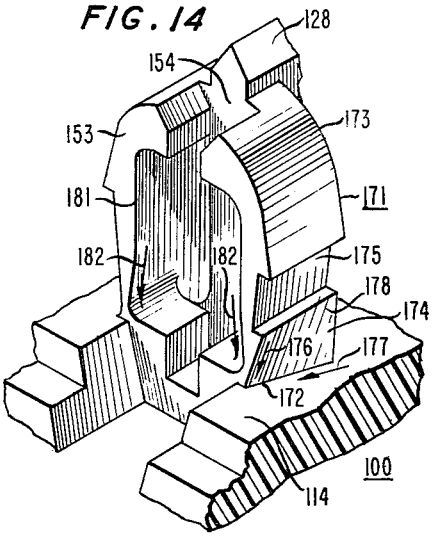
FIG. 14 depicts an alternative embodiment of the bottom section of the upright arms of the risers in the index strip.
Figure 13:
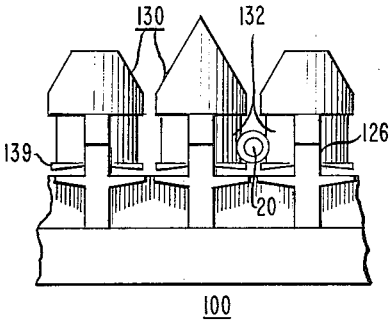
FIG. 13 depicts an alternative embodiment of the flanges of the index strip and the index-strip portion of the connector module.

FIGS. 13 and 14 depict alternative configurations for the upright members 110 (FIG. 1) of the index strip 100. FIG. 13 depicts one embodiment in which the flanges 130 also include thickened sections or lips 139 at the lowermost edge. As a result, during indexing the smallest conductors 20 are entirely contained between the lower flange sections 132 for maximum centering.

FIG. 14 depicts another embodiment in which the bottom sections 174 of the arms 171 are thinned in the region of the junction 172 with ledge 114 in a different fashion to generate a smaller wire-retaining slot width which is desirable for smaller conductors. The outer sidewall 173 undergoes a tapering downward, beginning from the top of the bottom section 174 rather than middle section 175, as depicted by arrow 176, and rearward, as depicted by arrow 177 to form a surface 178 diagonal to the axis of the wire-retaining slot 112 (FIG. 5) and the upright members 110 (FIG. 5). In addition, the inner sidewall 181, along the bottom arm section 174, undergoes a taper in the downward direction, as denoted by arrow 182. Hence, the region of the junction 172 is still defined by a thinned wall which generates a minimum of vertical ejection forces.

Figure 16:
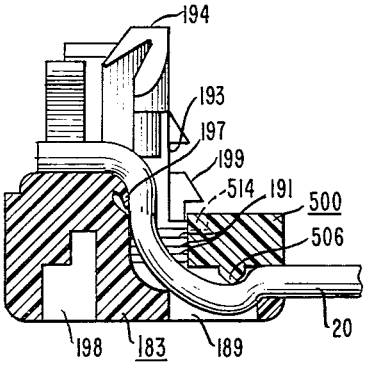
FIG. 16 depicts in cross-sectional view the FIG. 15 index strip cooperating with its retaining strap in securing a conductor 20.
Figure 15:
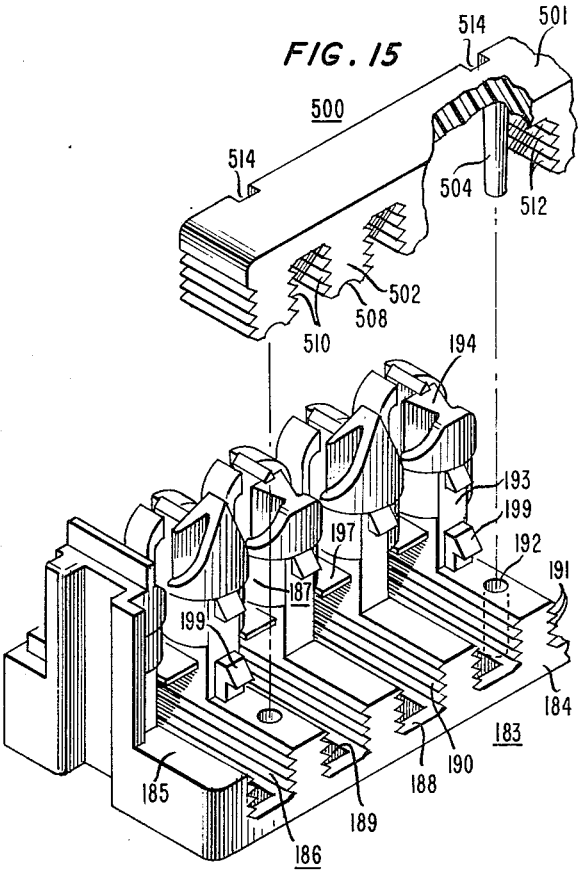
FIG. 15 shows in partial front view an index strip in which the front side is modified to terminate wires in the factory and its corresponding retaining strap.

Increasingly, cables are preconnectorized in the factory. Shown in FIGS. 15 and 16 is another alternative embodiment 183 of the index strip, which is useful for factory terminations, and in which the base 184 extends outward to define a shelf 185 instead of a ledge 113 (FIG. 1). The shelf 185 is partitioned with a plurality of grooves 186 which are longitudinally in line with but vertically offset from associated wire-retaining slots 187 as shown in FIG. 15. The bottom 188 of each groove 186 has a rectangular strain-relief opening 189 while the sidewalls 190 of each groove 186 include vertically spaced horizontal ribs 191 that hang slightly downward. On the top surface of the shelf 185 are a plurality of periodically occurring aligning holes 192. A number of latching tabs 199 also extend from some of the front walls 193 of the posts 194. When the conductors 20 are indexed into the wire-retaining slots 187, they are laced into the grooves 186 as well.

A retainer strap 500 holds the inserted conductors in place in the shelf 185. The strap 500 comprises a strip 501 of flexible plastic material with a plurality of spaced-apart legs 502 corresponding to the grooves 186, aligning dowels 504 corresponding to the holes 192 and notches 514 corresponding to the tabs 199. The legs 502 include elongate concave bottom surfaces 508 with triangular projections 506 protruding therefrom to crimp the conductors 20 into the rectangular openings 189. The sidewalls 510 of each leg 502 include vertically spaced horizontal ribs 512 that tip slightly upward. Many latching positions of the retainer strap 500 with the strip index 183 can occur to accommodate a wide range of conductor sizes. When the largest conductors 20 are indexed, the tabs 199 engage the notches 514 to supplement the hold between the legs 502 of the strap 500 and the grooves 187 of the index strip 183.

This shelf-retainer strap structure prevents additional strains otherwise put on the wires 20 in the wire-retaining slots 187 during cable installation. The strap 500 can be removed in the field before splicing.

FIG. 16 illustrates that single cantilever beams 197 are used in this embodiment. The cavity 198 is for tool mounting.

Connector Module

For purposes of clarity, the connector module 200 will be described with respect to its component parts. The module 200 is an assembly of a front module component 201 and a rear module component 202 as depicted in FIG. 8.

The rear module component 202 comprises an index-strip portion 203 with a skirt 204 beneath the strip portion 203. At either end wall 219 of the index-strip portion 203 are vertical grooves 205 for mounting the connector module 200 onto a holder.

The index-strip portion 203 comprises an elongate base 206 on which are mounted a plurality of longitudinally spaced-apart upright members 210. Between the upright members 210 are wire-retaining slots 212 for holding the insulated conductors or wires 30 of a second group. Similar to the index strip members 110, each upright members 210 comprises a front post 220, a dome-roofed riser 250 in the rear end, and a web 240 connecting the post 220 and the riser 250.

Figure 8:
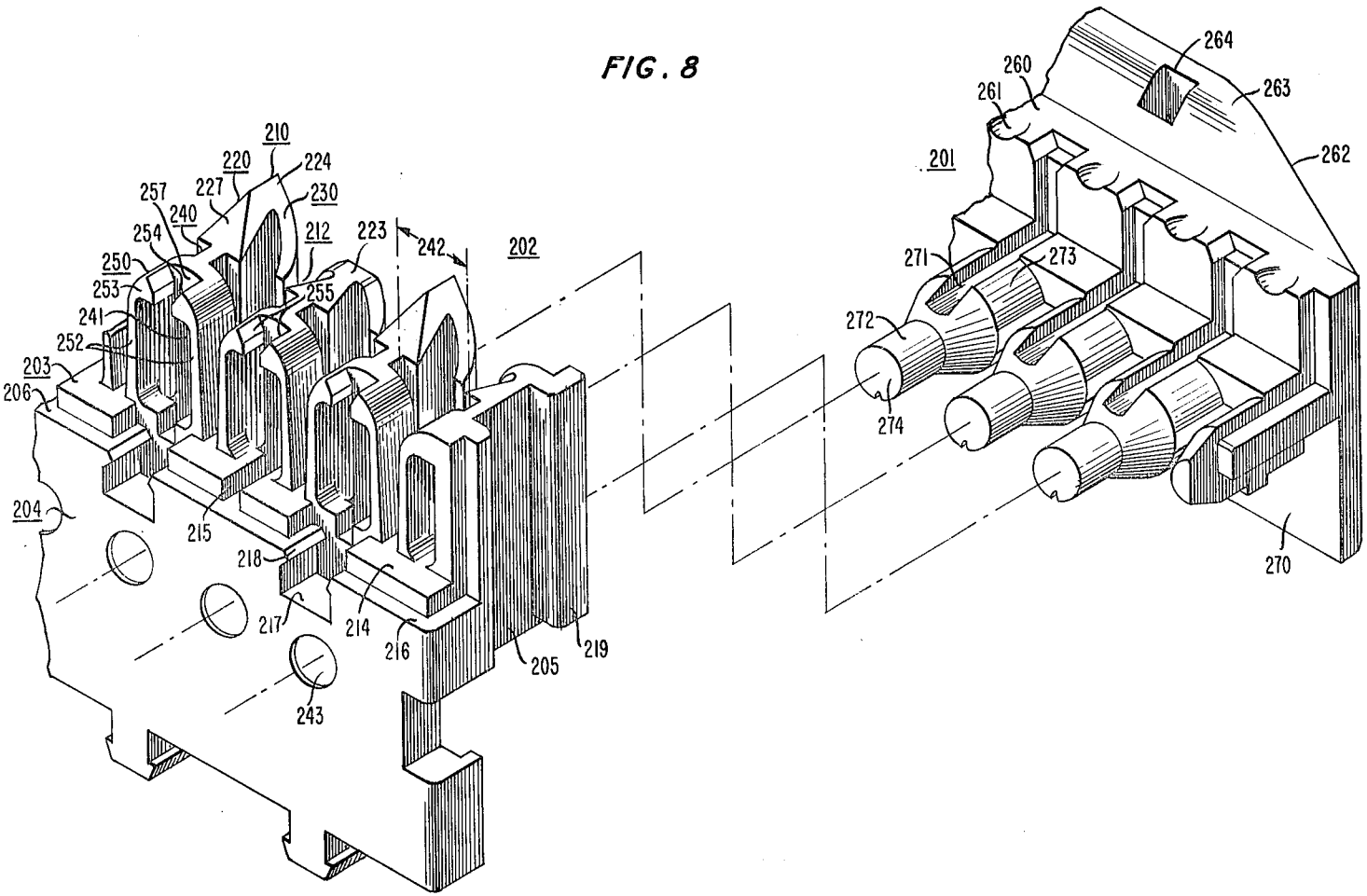
FIG. 8 depicts an exploded and partial isometric rear view of the connector module.

As can be seen in FIGS. 1 and 8, alternate posts 220 have peaked cathedral roofs 224 while others have flat roofs 223. Those posts 220 with peaked cathedral roofs 224 have chamfered rear roof surfaces 227. Each post 220 is also somewhat triangular in cross section, and has a flattened apex front wall 221 with a latching nub 222.

As most clearly seen in FIG. 8, along the length of the rear side of the index strip portion 203 are a ledge 214, and a notched edge 216, both extending rearwardly beyond the risers 250. The ledge 214 and edge 216 are broken periodically by slots 217 which have beveled snap-in wings 218.

The risers 250 have horizontally deflectable upright arms 252 and thickened shoulders 253. The shoulders 253 also include a vertical through notch 254 having a funnel-shaped entrance 255 and a recessed wall 257 coplanar with the recessed rear wall 241 of the web 240. Likewise, the ledge 214 includes a plurality of notches 215, each notch 215 in vertical alignment with the associated web 240 and shoulder notch 254.

Figure 9:
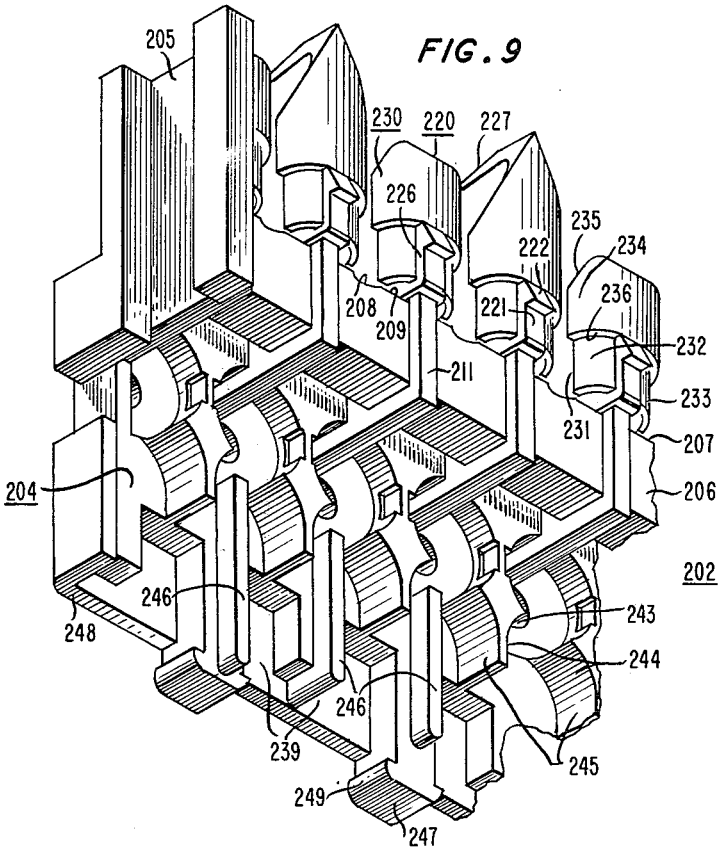
FIG. 9 is a partial isometric front view of the rear connector module component.

Referring to FIG. 9, pairs of flexible flanges 230, identical to the flanges 130 in the index strip 100, integrally attach to adjacent sidewalls 226 of adjacent posts 220. Each flange 230 includes a thicker upper flange section 234, a tapering entrance guiding surface 235, a lip 236, a lower flange section 232 with a roughened surface 233, and a wire-gripping edge 231. Each pair of flanges 230 cooperates with associated risers 250 to align and center as assigned wire 30 in a fashion similar to the corresponding components in the index strip 100.

Along the front side beneath the posts 220, the base 206 forms a substantially horizontal floor 207. Concave depressions 208 appear periodically in the floor 207 to form a scalloped front edge 209. Each depression 208 is centered in each wire-retaining slot 212.

Beneath the elongate base 206, the skirt 204 of the rear module component 202 includes capsule-shaped holes 243, partial arches 244 which are bordered by downwardly extending wire stuffers 245, and a plurality of vertical ribs 246 chamfered at their bottom and disposed between the stuffers 245. Legs 247, which include arrowback grips 249, extend downward below the bottom edge 248 of the skirt 206. Along the lower part 204 of the skirt and disposed between the ribs 246 are recesses 239 for containing the exposed and severed ends of the conductors 20.

Referring back to FIGS. 1 and 8, the front module component 201 comprises an elongate top ledge 260 with longitudinally spaced depressions 261 which align with the depressions 208 in the rear module component 202. The ledge 260 cooperates with the floor 207 of the index-strip portion 203 to operate as an upper snubbing brace surface 259. An upper rail 262, having an upwardly tapering surface 263 with latching holes 264 (only one shown), integrally attaches to the ledge 260. The front module component 201 also includes a lower rail 265 with latching holes 266.

Between the rails 262, 265 are surfaces 267 separated by vertical walls 268. On each surface 267 is a horizontal through bridging slot 269 in line with a waist 46 of a mounted contact element 40. The rails 262, 265 and the slots 269 are for engaging a bridge connector, such as the one mentioned in Frey et al. It is apparent that the prior art bridge connector, which includes an index-strip component and cap, can have features similar to the functionally similar components in connector 10.

The underside of the lower reail 265 forms a lower snubbing brace surface 270. Horizontal slots 258 in the rail 265 occur for manfuacturing purposes.

The front module component 201 has on its backside L-shaped grooves 271 which interlock with corresponding L-shaped projections 211 (FIG. 9) on the elongate base 206 of the rear component 202, and space capsule-like projections 272 which include circular surfaces 273 and pin-like ends 274.

Figure 10:
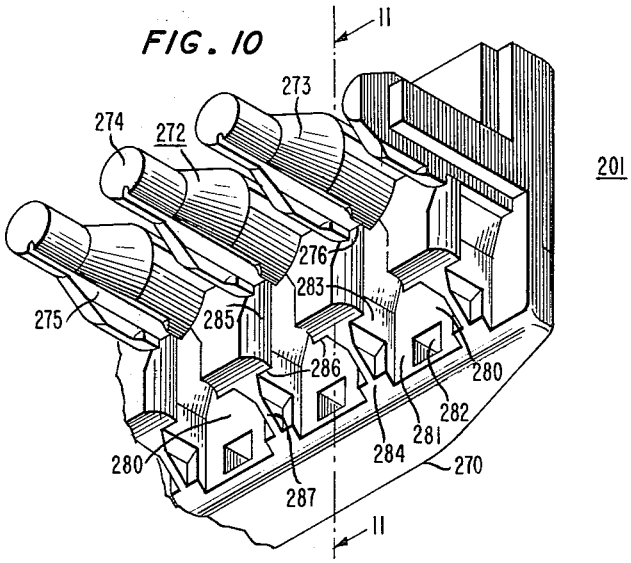
FIG. 10 is a partial isometric rear view of the front connector module component.
Figure 11:
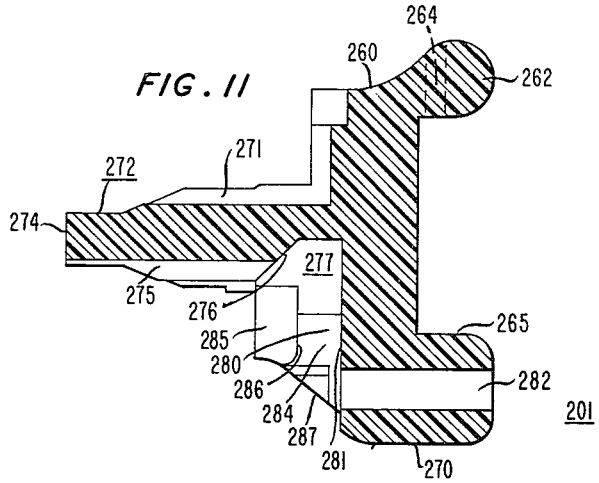
FIG. 11 is a section view along line 11—11 in FIG. 10 of the front connector module component.

Most clearly depicted in FIGS. 10 and 11, along the bottom of the projections 272 are grooves 275 along the axis of the projections 272 for interlocking with the triangular ribs 128 of the upright members 110 in the index strip 100.

Beneath the capsule-like projections 272, the front module component 201 comprises a plurality of recesses 280, one for containing the front end of each upright member 110 of the index strip 100. Each recess 280 is defined by a wall 281 on which there is a latching hole 282 for catching the corresponding latching nub 122, sidewalls 283 which are defined by vertically partitions 284, latching surfaces 286 defined by vertically partitions 284, latching surfaces 286 defined by wings 285 on the partitions 284, and ceilings formed by cavities 277 in the base of the capsule-like projections 272.

Alternating recesses 280 are adjusted to accommodate the posts 120 with peaked cathedral roofs 124. The ceilings formed by the capsule-like projections 272 associated with the posts 120 having peaked cathedral roofs 124, include chamfered surfaces 276 which correspond to the chamfered roof surfaces 127 of the index strip 100.

The latching surfaces 286 of the wings 285 and the chamfered surfaces 276 of the capsule-like projections 272 in the front module component 201 interlock with the respective front posts 120 and their attached flanges 130 to prevent forward movement of the front module component 201. Hence, internal mechanical stresses on its pin-like ends 274 which are heat-staked and riveted after threading through holes 243 (FIG. 8) of the rear module component 202 are reduced.

The partitions 284 are thinned and tapered near the bottom to define stuffing surfaces 287 for urging the conductors 20 against the split platforms 143 in the wire-retaining slots 112 of the index strip 100 along with brace 270.

As shown in FIG. 1, the connector module 200 carries contact elements 40. Each contact element 40 is basically an elongated conductive body 41 comprising bifurcated top and bottom end portions 42, 43 respectively, each of which defines a wide-mouthed entrance to insulation-piercing end slots 44, 45 respectively. The slots 44, 45 extend toward the narrow waist section 46 and terminate within the body 41 before the body begins undergoing the indentations 47.

The contact elements 40 are held in position in the module 200 with the circular surfaces 273 (FIG. 8) and by a well 242 (FIG. 8) formed of a void between adjacent webs 240, the interior surfaces of the adjacent upright arms 252 and the adjacent posts 220. When mounted in the module 200, each contact element 40, is located with its upper insulation-piercing slot 44 in line with its associated wire-retaining slot 212 in the connector module 200.

Referring back to FIG. 1, as the module 200 is applied to the index strip 100, the lower insulation-piercing end slot 45 of each contact element 40 enters the associated vertical slot 145 and wells 146 in index strip 100 to align with the associated wire-retaining slot 112 and to engage the associated wire 20.

At the same time, the partial arches 244 (FIG. 9) engage the dome surfaces 162 (FIG. 5) of the risers 150 while the vertical ribs 246 (FIG. 9) interlock with the notches 154, 116 (FIG. 5) of the risers 150 and the ledge 114 respectively, on the index strip 100.

In the illustrative embodiment, the conductors 20 in the index strip 100 are cut before applying the illustrated connector module 200. Interlocking the vertical ribs 246 with the notches 154, 116 reinforces the skirt 206 and aids to guide its mounting onto the index strip 100. The interlocking also increases the dielectric breakdown and water paths between severed conductors 50 in an encapsulant-filled connector. Where the conductors 20 are not severed, the rear module component 202, as shown in FIG. 9, can be modified to have through openings in the skirt 204 instead of recesses 239.

Referring back to FIG. 1, along the front side of the connector 10, as the module 200 presses down onto the index strip 100, the brace 270 effects bending contact with the indexed insulated conductors 20, deflecting the platforms 142 and the conductors downwardly until the latching holes 282 lock into the latching nubs 122 of the index strip 100. At this point, each conductor 20 is firmly snubbed by the brace 270.

Cap Structure

Figure 12:
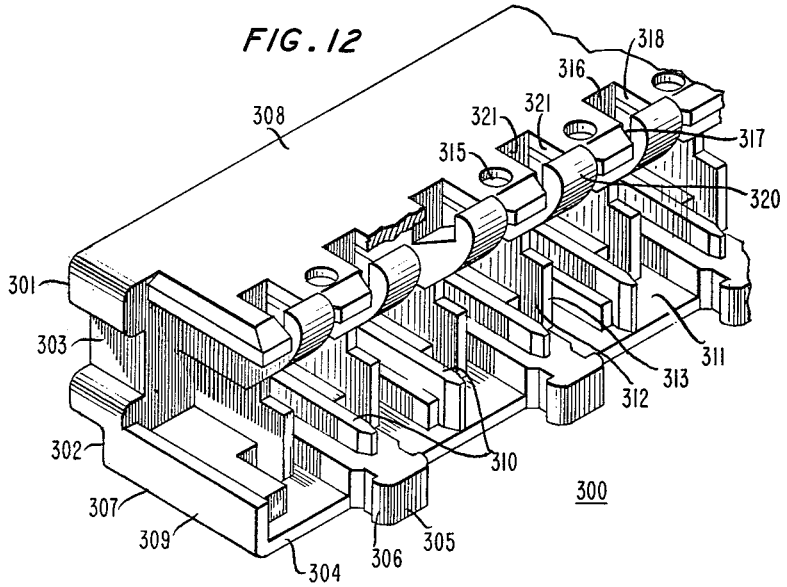
FIG. 12 is a partial isometric view of the connector module cap.

As seen in FIGS. 1 and 12, the cap 300 consists of a generally elongate flat roof 301 with a longitudinal rear ledge 302 which accommodates a compression blade, a front wall 308, a rear wall 307, two end walls 309 (one shown), and a vertical groove 303 along each end wall 309.

In the rear wall 307 of the cap 300 is a bottom rear edge 304, which is continuous but for legs 305, each of which includes a pair of arrowback grips 306. The legs 305 fit into the slots 217 (FIG. 8) of the connector module 200, while the rear edge 304 abuts the notched edge 216 (FIG. 8). Seen along the interior of the wall 307 are a plurality of vertical reinforcement ribs 310 substantially the height of the rear wall 307 for interlocking with the vertical through notches 254 in the risers 250 and the notches 215 in the ledge 214 of the connector module 200, as shown in FIG. 8, to function in a similar fashion to the ribs 246 (FIG. 9) in the connector module 200. The rear wall 307 also includes wire recesses 311, which align with the wire-retaining slots 212 (FIG. 8) of the connector module 200, for receiving the exposed and severed ends of the conductors 30. Above each wire recess 311 is a wire stuffer 312 formed by a downwardly depending rib whose bottom surface 313 terminates near the top of recess 311.

The front wall 308 includes plural latching holes 315 similar to the latching holes 282 in the module 200, and plural spaced slots 316, each of which includes a wide lower slot region 317 and a narrow upper slot region 318. Each lower region 317 is wider than an associated beam 320 that deflects when coming in contact with a conductor 30 present on the upper snubbing surface 259 (FIG. 1) of module 200. The sidewalls 321 of the upper slot region 318, form a tight interference fit with a deflected beam 320 and require slight plastic upset along them for upward movement of the beam 320. The sidewalls 321, hence, support the beam in snubbing a conductor 30.

Occasionally, water-proof encapsulant is placed in the cap 300 as in the other connector components 100 and 200 prior to their assembly. The latching holes 315 are advantageously in line with the upper slot regions 318 to minimize escape of encapsulant during placement of the cap 300 onto the connector module 200.

It is to be understood that the embodiments described herein are merely illustrative of the principles of the invention. Various modifications may be made thereto by persons skilled in the art without departing from the spirit and scope of the invention.

I claim:

1. An index strip (100) for receiving axially elongated conductors or wires including a base (102) of electrically insulative material on which are mounted a plurality of spaced upright members (110) defining a plurality of wire-retaining slots (112), each wire-retaining slot having a first end substantially defined by two flexible inwardly curved flanges (130) attached to sidewalls (126) of corresponding upright members (110), and having free ends opposite their sidewall attachments, the flanges being deflectable to vary the dimension of the first end for a conductor (20) inserted and to deflect inwardly during wire indexing to draw said free ends further inwardly along the axial direction of the inserted conductor to securely grip the inserted conductor, the deflected flanges tending to bias toward each other to create a tighter holding grip on the conductor when conductor pull out opposite the inward deflection is attempted.

2. The apparatus (100) pursuant to claim 1 where each flange (130) includes a flange section (132) with a roughened surface (133) for gripping an inserted conductor (20).

3. The apparatus (100) pursuant to claim 1 further comprising:

means for vertically retaining (134) each conductor (20) in its associated wire-retaining slot (112) at the first end.

4. The apparatus (100) pursuant to claim 3 where the flanges (130) form the vertical retaining means (134) with upper flange sections (134) which define lips (136) protruding over gripping surfaces (133) of lower flange sections (132).

5. The apparatus (100) pursuant to claim 1 where the flanges (130) have tapered surfaces (135) for defining funnel-like entrances to the first end of the slots (112).

6. The apparatus (100) pursuant to claim 1 further comprising:

vertically yielding wire confining means (143).

7. The apparatus (100) pursuant to claim 6 where the vertically yielding wire confining means (143) comprises:

a pair of flexible membranes (142) extending substantially horizontally from adjacent members (110) with their extended ends substantially adjacent each other.

8. The apparatus (100) pursuant to claim 7 where the base (102) includes a floor (105) between each pair of adjacent members (110), the floor tilting upward to the interior of the strip.

9. The apparatus (100) pursuant to claim 8 where each flexible membrane (142) fixedly attaches to the associated floor (105) substantially at an interior edge (107) of the floor.

10. The apparatus (100) pursuant to claim 1 where the flanges (130) associated with each slot (112) are substantially identical in configuration and are capable of deflecting substantially the same amount to center the associated conductor (20) in the slot (112) at the first end.

11. The apparatus (100) pursuant to claim 10 further comprising:

means for centering (150) an associated conductor (20) at a second end of each slot (112), each centering means (150) cooperating with the associated flanges (130) at the first end to substantially center each conductor (20) along the entire length of the slot (112).

12. The apparatus (100) pursuant to claim 11 where the centering means (150) comprises:

horizontally yielding wire-retaining slot means defined by adjacent flexible arms (152).

13. The apparatus (100) pursuant to claim 12 where each arm (152) comprises a top section (163), a thinned middle section (164), and a bottom section (165) which gradually thins out in a region of the junction adjoining the base (102).

14. The apparatus (100) pursuant to claim 13 where the arms (152) are in a rear end of the slot (112) and where outer sidewalls (166) of their bottom sections (165) taper downward and rearward.

15. The apparatus (183) pursuant to claim 1 where the base (184) extends outward from the first end of the wire-retaining slots (187) to define a shelf (185) with a plurality of wire-receiving grooves (186), each groove (186) being in longitudinal alignment with its associated wire-retaining slot.

16. The apparatus (183) pursuant to claim 15 where the bottom (186) of each groove (186) is vertically offset with respect the associated wire-retaining slot (187).

17. The apparatus (183) pursuant to claim 16 where each groove (186) includes sidewalls (190), each sidewall including a plurality of vertically-spaced horizontal ribs (191).

18. In combination with the apparatus (183) in accordance with claim 17, a retainer strap (500) comprising an elongate strip (501) with a plurality of spaced-apart legs (502) for interlocking with the grooves (186).

19. The combination pursuant to claim 18, where each leg (502) in the retainer strap (500) includes a plurality of vertically spaced horizontal ribs (512) on either sidewall (510) for interlocking with the ribs (191) in the associated groove (186) of the apparatus (183).

20. A modular connector (10) for electrically terminating a plurality of conductors (20), the connector comprising:

a terminal strip (100) including a base (102) of electrically insulative material on which are mounted a plurality of spaced upright members (110) defining a plurality of wire-retaining slots (112), the conductors being inserted downward into each slot from the top of the strip, each upright member comprising a vertical notched means (156, 116) along a rear side of the strip;

means for electrically terminating (40) the conductors (20);

a covering structure (200) for matingly engaging and interlocking with the terminal strip, the covering structure having one wall (204) for engaging the rear side of the strip, the wall comprising vertical ribs (246) which seat into the notched means of the members (110).

21. The connector (10) pursuant to claim 20 where the members (110) in the terminal strip (100) include aligning tabs (128) along the top of each member (110) and where the covering structure (200) includes grooves (275) associated with the aligning tabs.

22. The connector (10) pursuant to claim 21 where the aligning tabs (128) are parallel to the slots (112) in the strip (100).

23. The connector (10) pursuant to claim 22 where alternate tabs (128) interface with rear chamfered roof surfaces (127).

24. The connector (10) pursuant to claim 23 where the covering structure includes latching surfaces (276) for engaging the chamfered roof surfaces (127) of the terminal strip (100).

25. Apparatus for connecting a first group of conductors (20) to a second group of conductors (30) of the type comprising:

an index strip (100) for receiving axially elongated conductors or wires comprising an elongate base (102) of electrically insulative material on which are mounted a plurality of upright members (110) and having free ends opposite their sidewall attachments defining a plurality of first wire-retaining slots (112), each with a first and second end;

a connector module (200) comprising an elongate structure made of electrically insulative material including:

an index strip portion (203) with an elongate base (206) on which are mounted a plurality of upright members (210) defining a plurality of second wire-retaining slots (212), each with a first and second end;

a plurality of double-ended conductive means (40) having first and second ends (43,42), each mounted with its second end (42) disposed across the associated second wire-retaining slot;

a cap (300) for mounting onto the index-strip portion (203) of the connector module (200):

a pair of first flexible inwardly curved flanges (230) defining substantially the first end of each second wire-retaining slot (212);

a pair of second flexible inwardly curved flanges (230) defining substantially the first end of each second wire-retaining slot (112); and where each pair of flanges are capable of deflecting to vary the dimension of the first end for the conductor (20, 30) inserted and deflect inwardly during wire indexing to draw said free ends further inwardly along the axial direction of the inserted conductor to securely grip the inserted conductor, the deflected flanges tending to bias toward each other to create a tighter holding grip on the inserted conductor when conductor pull out opposite the inward deflection is attempted.

26. The apparatus (10) pursuant to claim 25 where the flanges (130, 230) associated with each wire-retaining slot (112, 212) are capable of deflecting substantially the same amount to center the associated conductor (20, 30) in the first end of the wire-retaining slot.

27. The apparatus (10) pursuant to claim 26 further comprising:

means for centering (150, 250) an associated conductor (20, 30) at the second end of each wire-retaining slot (112, 212), each centering means cooperating with the associated flanges (130, 230) at the first end to substantially center each conductor along the entire length of the wire-retaining slot.

28. The apparatus (10) pursuant to claim 27 where each centering means (150, 250) comprises:

horizontally yielding wire-retaining slot means (150, 250) defined by adjacent flexible upright arms (152, 252).

29. The apparatus (10) pursuant to claim 28 where each upright member (110, 210) includes a post (120, 220) with the flanges (130, 230) in the first end and a riser (150, 250) with a pair of the upright arms (152, 252) in the second end, each riser including a dome-shaped shoulder (153, 253) connected to one end of the arms while the other end of the arms integrally attach to a ledge (114, 213).

30. The apparatus (10) pursuant to claim 29 where each shoulder (153, 253) and ledge (114, 213) include notched portions (154, 254), (116, 215) respectively;

where the connector module (200) includes a skirt (204) for substantially enclosing the second end of the slots (112) in the index strip, the skirt including a plurality of vertical reinforcement ribs (246) each rib associated with and for interlocking with the associated notch portions (156, 116) in the index strip (100); and where the cap (300) includes a wall (307) for substantially enclosing the second end of the slots (212) in the index-strip portion (203) of the connector module (200), the wall including a plurality of vertical reinforcement ribs (310), each rib associated with and for interlocking with the associated notch portions (254, 215) in the index-strip portion of the connector module.

31. The apparatus (10) pursuant to claim 25 comprising:

means for vertically retaining (134, 234) each conductor (20, 30) in its associated wire-retaining slot (112, 212) at the first end.

32. The apparatus (10) pursuant to claim 25 where each flange (130, 230) is defined by an upper flange section (134, 234) and a lower flange section (132, 232), the upper flange section forming a lip (136, 236) protruding over the lower flange section to cooperate with the lip of an adjacent flange to retain an associated conductor (20, 30) in the wire-retaining slot (112, 212).

33. The apparatus pursuant to claim 25 where the connector module (200) is formed by assembling a front component (201) and a rear component (202) containing the index-strip portion (203), the front component being molded to include a plurality of recesses (280) with surfaces (286) for interlocking with the flanges (130) in the index strip (100).

* * * * *

UNITED STATES PATENT AND TRADEMARK OFFICE

CERTIFICATE OF CORRECTION

PATENT NO. : 4,262,985

DATED : April 21, 1981

INVENTOR(S) : Almon A. Muehlhausen II

It is certified that error appears in the above—identified patent and that said Letters Patent is hereby corrected as shown below:

Column 4, line 12, "mdoule" should read --module--.
Column 5, line 18, "post" should read --posts--.
Column 9, line 10, "reail" should read --rail--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*